US009850608B2

(12) United States Patent
Cerliani

(10) Patent No.: US 9,850,608 B2
(45) Date of Patent: Dec. 26, 2017

(54) ROTARY HOOK WITH BOBBIN CASE FOR A LOCKSTITCH SEWING MACHINE INCLUDING MEANS TO REDUCE THE PLAYS BETWEEN BOBBIN CASE AND BASKET AND TO REDUCE THE NOISE THEREOF

(71) Applicant: CM CERLIANI S.R.L., Pavia (IT)

(72) Inventor: Daniele Cerliani, Pavia (IT)

(73) Assignee: CM CERLIANI S.R.L., Pavia (IT)

( * ) Notice: Subject to any disclaimer, the term of this patent is extended or adjusted under 35 U.S.C. 154(b) by 666 days.

(21) Appl. No.: 14/196,248

(22) Filed: Mar. 4, 2014

(65) Prior Publication Data

US 2014/0245937 A1 Sep. 4, 2014

(30) Foreign Application Priority Data

Mar. 4, 2013 (IT) ..... MI2013A0324

(51) Int. Cl.
*D05B 57/14* (2006.01)
*D05B 57/16* (2006.01)
*D05B 69/32* (2006.01)

(52) U.S. Cl.
CPC ..... *D05B 57/14* (2013.01); *D05B 57/16* (2013.01); *D05B 69/32* (2013.01)

(58) Field of Classification Search
CPC .... D05B 57/14; D05B 57/143; D05B 57/146; D05B 57/16; D05B 69/32
See application file for complete search history.

(56) References Cited

U.S. PATENT DOCUMENTS 4,089,282 A * 5/1978 Cerliani ..... D05B 57/26 112/229
4,429,649 A 2/1984 Eguchi et al.
4,577,572 A * 3/1986 Hirose ..... D05B 57/16 112/231
4,970,975 A 11/1990 Ando et al.
5,165,354 A * 11/1992 Wahlstrand ..... D05B 57/16 112/228
5,351,636 A 10/1994 Hirose
(Continued)

FOREIGN PATENT DOCUMENTS

DE 890 303 C 9/1953
DE 78 01 289 U1 5/1978
(Continued)

OTHER PUBLICATIONS

IT Search Report, dated Dec. 6, 2013, from corresponding IT application.

*Primary Examiner* — Nathan Durham
(74) *Attorney, Agent, or Firm* — Young & Thompson

(57) ABSTRACT

A rotary hook (1) of a lockstitch sewing machine composed of at least one hook body (2) includes a cylindrical cavity (11) and a basket (6, 6*b*) free to rotate in the cylindrical cavity (11), a bobbin case (8, 8*b*) housed in the basket (6, 6*b*) and a bobbin (4, 4*b*) housed in the bobbin case (8, 8*b*), elements (30, 40, 50, 60, 61, 70,) suited to create a friction between the bobbin case (8, 8*b*) and the basket (6, 6*b*), so as to prevent the bobbin case (8, 8*b*) to move freely and to vibrate within the plays present between the bobbin case (8, 8*b*) and the basket (6, 6*b*) and to consequently reduce the noisiness created during the sewing operation.

6 Claims, 19 Drawing Sheets

(56) References Cited

U.S. PATENT DOCUMENTS

| | | | | |
|---|---|---|---|---|
| 5,413,058 | A * | 5/1995 | Hirose | D05B 57/265 112/231 |
| 5,651,323 | A * | 7/1997 | Hirose | D05B 57/16 112/231 |
| 7,171,914 | B2 | 2/2007 | Ota et al. | |
| 8,342,110 | B2 | 1/2013 | Cerliani | |
| 2010/0126399 | A1 * | 5/2010 | Cerliani | D05B 69/32 112/231 |

FOREIGN PATENT DOCUMENTS

| | | | |
|---|---|---|---|
| EP | 1 640 490 | A1 | 3/2006 |
| WO | 93/20273 | A1 | 10/1993 |

* cited by examiner

PRIOR ART

ROTARY HOOK WITH BOBBIN CASE FOR A LOCKSTITCH SEWING MACHINE INCLUDING MEANS TO REDUCE THE PLAYS BETWEEN BOBBIN CASE AND BASKET AND TO REDUCE THE NOISE THEREOF

BACKGROUND OF THE INVENTION

The present invention relates to a rotary hook (in execution with bobbin case) for a lockstitch sewing machine (with one needle thread and one bobbin thread), both for home and industrial use, which comprises means to reduce the noise thereof caused by the plays between the bobbin case and the basket of the hook.

The invention relates further to a lockstitch sewing machine comprising such a rotary hook comprising means to reduce its noise caused by the plays between bobbin case and basket of the hook.

The rotary hook can be of the type with a horizontal axis of rotation or of the type with a vertical axis of rotation.

DESCRIPTION OF THE RELATED ART

Lockstitch sewing machines and the associated rotary hooks are well known and therefore will not be described herein, where it will be merely recalled that the rotary hook, in execution with bobbin case, comprises at least one hook body, which is connected to a shaft from which it receives motion and which comprises a cylindrical cavity of the hook body, a basket free to rotate inside the cylindrical cavity of the hook body and which in turn comprises a well of the basket, a gib which helps to constrain the basket to the hook body and a bobbin case which is placed inside the well of the basket and that helps to constrain the bobbin to the basket.

The shaft can be integral with the hook body, or housed in a hole present in the center of the cylindrical cavity of the hook body.

The bobbin case, containing the bobbin with the bobbin thread, is mounted and removed by the sewing machine operator at each change of the bobbin, through an axial translation, where the external diameter of the bobbin case is inserted with radial play inside the inner diameter of the well of the basket and the post of the basket, if present, is inserted with radial play into the center hole of the shaft of the bobbin case (in fact there are some embodiments in which the bobbin case and the basket do not have the central shaft and the post respectively in order to allow the use of bobbins without center hole).

The angular reference for the correct mounting of the bobbin case in the basket is given by the coupling with angular play between a projection on the inner diameter of the well of the basket and a guide, parallel to the axis of the hook, provided on the external diameter of the bobbin case. The axial constraint of the bobbin case on the basket, to prevent accidental disassembly during sewing, is secured by the latch slide of the bobbin case, which engages on the basket with an axial play. The linkage created by the latch lever on the latch slide allows the operator to release the latch slide, and then the bobbin case, from the axial constraint on the basket, in order to remove the bobbin case.

The basket is constrained to the hook body by a rib, formed on the outer surface thereof, which engages in a race, formed in the inner wall of the cylindrical cavity of the hook body, which prevents the axial and radial translation of the basket with respect to the hook body, but not the rotation thereof.

The race of the hook body and the rib of the basket must be interrupted for a certain angular sector to allow the needle thread to pass and the stitch to be formed: these interruptions prevent the use of bearings, making necessary a coupling of the sliding type (that is with a sliding friction) between the race of the hook body and the rib of the basket, originating also, during the rotation of the hook body, a source of noise due to the play existing between the rib of the basket and the race of the hook body and to the fact that habitually they are made of metal materials.

Said source of noise, well known, and possible means to reduce it have been already subject of studies (see for example Italian patent no. 1.392.162; EPO no. 09176587.5).

U.S. Pat. No. 5,351,636 Patent deals with the problem of reducing the coefficient of friction between the basket and the hook body without taking absolutely into consideration the problem of the noise generated by the hook. In addition the play between the bobbin case and the basket are not even taken into consideration, as it does not contribute to the friction between the basket and the body hook. For this reason the noise generated by the play between the bobbin case and the basket is not considered nor affected by said patent.

The Italian patent 1.392.162 (or EPO 09176587.5 or U.S. Pat. No. 8,342,110) describes a rotary hook comprising means to reduce the noise caused by the plays between the basket and the hook body. This object is achieved by means apt to apply on the basket an axial stress that forces the rib of the basket to lean on one of the two flat surfaces of the race present in the circular cavity of the hook body, instead of vibrating freely in said race due to the always present play between said rib and said race. This axial stress has the effect of stabilizing the basket, preventing the vibration and the resonance. This patent, however, does not concern in any way the noise generated by the plays between the bobbin case and the basket of the hook.

U.S. Pat. No. 7,171,914 (or EP 1640490) Patent describes a hook with a vertical axis in which the basket and the hook body are made of synthetic material (synthetic resins) and the basket is constrained to the hook body by magnetic means inserted in the bottom wall of the basket and on the bottom of the cylindrical cavity of the hook body, allowing the structure of the hook to be simplified (for example, the gib and C-shaped race formed in the inner wall of the cylindrical cavity of the hook body are not provided) and the production costs thereof to be reduced. The magnets described thus serve to constrain to the hook body a basket made of synthetic material, which otherwise would be free to fluctuate, due to the simplification of the hook's structure ("L" shaped race instead of the "C" shaped race and the consequent absence of the gib). This invention does not deal with the problem of the noise issue between basket (inner rotary hook) and bobbin case as in this execution of rotary hook, the bobbin case is not present and the bobbin is housed directly inside the basket.

U.S. Pat. No. 4,429,649 Patent discloses a hook for home sewing machines where the basket (called "bobbin case holder") is constrained by a rib, provided on the outer surface of the basket, which engages in a "L" shaped race, provided in the inner wall of the cylindrical cavity of the hook body and delimited by only one plane surface and by a cylindrical surface perpendicular to the plane one, suitable to prevent merely the radial translation of the basket in the cylindrical cavity. Said basket is free to fluctuate in axial direction and a magnet positioned at the bottom of the cylindrical cavity of the hook body provides to adjust the tension of the lower thread. Also this patent, as the previously cited U.S. Pat. No. 7,171,914, refers to a rotary hook in execution without bobbin case.

SUMMARY OF THE INVENTION

The present invention relates to another source of noise, which is here discovered, mentioned and treated for the first time and the means to reduce the noise generated thereof. This further source of noise is due to the plays (radial, angular and axial) present between the bobbin case and the basket of the hook and to their usual constitution in metallic materials. Such plays, necessary for mounting and removing the bobbin case at each bobbin change, enable, however, also the bobbin case, once mounted, to move itself slightly inside the basket during the rotation of the hook body, such causing an additional noise. Both these noises are enhanced by vibration and resonance phenomena and are worsened by the passage of the needle thread during sewing, which pulls and tends to move the basket from its natural position. In fact such noises are considerably reduced during idling (running without thread) of the sewing machine.

The present invention deals exclusively with the means to reduce the noise caused by this second source of noise, identified and described for the first time in the present text, namely that due to the plays existing between the bobbin case and the basket of the hook. Merit of the present invention is, therefore, to have identified and separated conceptually this source of noise from other noise sources present in the hook and in the sewing machine, even before having found ways to reduce the noise generated by this source.

At the current state of the art it is not possible to eliminate such pays that allow easy mounting of the bobbin case in the basket and the causes of noise cannot be eliminated by adopting appropriate geometric shapes and/or imposing more stringent dimensional tolerances, which would increase anyway the manufacturing cost of the rotary hook.

Purpose of the present invention is therefore to provide a rotary hook comprising means suitable to reduce the noise caused by the plays between the bobbin case and the basket, within the negligible noise limits compared to the noise of the sewing machine This purpose has been achieved by means of the rotary hook object of the independent claim 1.

Further advantageous features are the subject of the dependent claims . . .

Substantially, the rotary hook according to the invention comprises at least one means, integral with the basket or integral with the bobbin case, that creates a sufficient friction between the bobbin case and the basket to prevent the bobbin case to move and to vibrate freely within the plays always present between said bobbin case and said basket, when mounted, but allowing an easy mounting/removing of the bobbin case, respectively with a slight additional axial pressure/traction compared to the normal mounting/removing operation (pressure to be obviously exercised after having disengaged the slide, as done with the rotary hooks of the prior art).

This friction, in a preferred embodiment, is exerted by an elastic means, which is deformed during the mounting of the bobbin case and has the effect of stabilizing the bobbin case, preventing its movement, vibration and resonance. To achieve this effect, the elastic means at rest (i.e. with the bobbin case removed) should occupy a volume such as to create a coupling with interference between the bobbin case and the basket. The mounting of the bobbin case deforms the elastic means just to obtain a correct coupling. Moreover, the presence of the elastic means, irrespective of its deformation, also creates an effect of shock absorber, absorbing the vibrations and reducing the residual noise.

For each embodiment is it preferable to have the means that create the friction, on the larger diameters (i.e. on the outer diameter of the bobbin case or the inner diameter of well of the basket, rather than on the diameter of the post of the basket or the diameter of the hole in the shaft of the bobbin case), as not only the friction force is important, but also the torque resulting therefrom and which is determined by said force and the arm between the axis of the bobbin case and the point of application of said force. Because of the moment of inertia of the bobbin case containing the bobbin full of thread, and the fact that the bobbin case is linked with play on the post of the basket and/or on inner diameter of the well of the basket, which acts as a pivot, the bobbin case also tends to rotate and vibrate around its own axis, besides having axial and radial movements. For this, a friction force applied near the axis of the bobbin case, even if it may be adequate to eliminate axial movements of the bobbin case, allowing always an easy mounting/removing of the bobbin case, is not suited to create instead a sufficient torque to prevent the movements and vibrations of the bobbin case around its axis; therefore it would improve only very partially the problem of the noise.

An advantage of the rotary hook object of the present invention consists in the fact that it can be applied to all existing sewing machines without having to modify their stitching members and without requiring any modification to a sewing machine available on the market.

Furthermore, a rotary hook made according to the invention is completely interchangeable with a rotary hook of the prior art, does not require any modification of the areas destined for the passage of the thread and in itself contains all the constructional features necessary to implement the invention.

BRIEF DESCRIPTION OF THE DRAWINGS

The invention will now be described with reference to some embodiments, which are examples, but not limits thereof, which are described in the appended figures, where.

The pairs of FIGS. 14-15, 16-17 and 18-19 respectively show in section and in side view various other embodiments of the bobbin case and the basket of a rotary hook according to the invention, in which are used elastic means that, when deformed during the mounting process of the bobbin case, create a friction on the bobbin case to reduce the noise caused by the plays between the bobbin case and the basket; In particular.

DETAILED DESCRIPTION OF THE INVENTION

In the appended figures, corresponding elements will be identified by the same numeral references.

Figure 1:
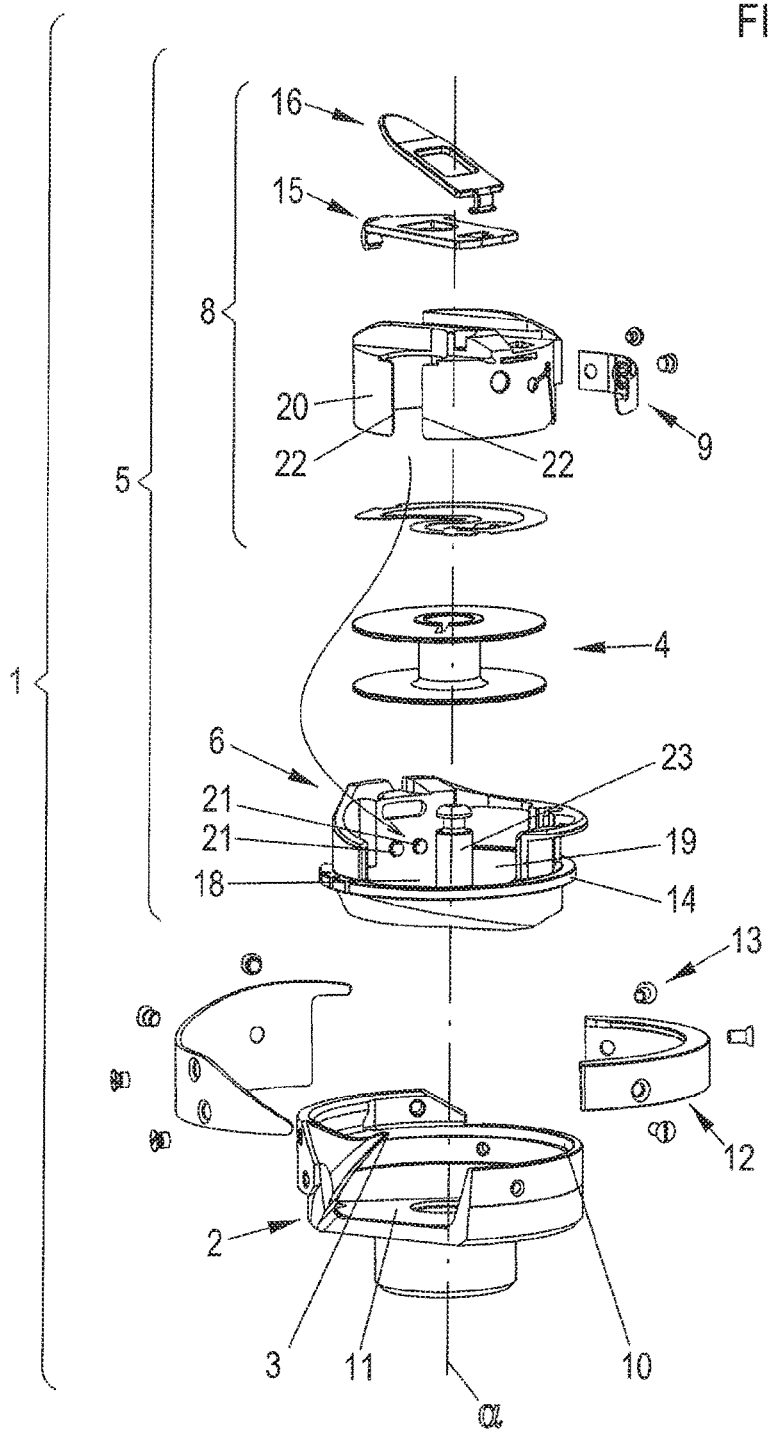
FIG. 1 shows schematically an exploded view of a rotary hook complete with bobbin case, of the prior art.

FIG. 1 shows schematically an exploded view of a rotary hook 1 with a horizontal axis "α" of rotation, of the prior art in which only the elements relevant to the present description have been identified by numeral references:

- a hook body 2, comprising a cylindrical cavity 11 which, in the example shown, has a central hole 17 (FIG. 2) suitable to receive a shaft (omitted for the sake of simplicity of the graphic representation) from which the hook 1 receives motion; in a different embodiment (of which the graphical representation is omitted), the shaft is integral with the hook 1;
- a basket 6, free to rotate within the cylindrical cavity 11 to which it is constrained by a rib 14, formed on the outer surface of the basket 6 and comprising: a well 18 of the basket 6 in which is housed the bobbin case 8 complete with bobbin 4, an inner diameter 19 delimiting said well 18 of the basket 6 in which fits the external diameter 20 of the bobbin case 8, a projection 21 on the inner diameter 19 of said well 18 of the basket 6, that coupling with the guide 22 (in the figures are indicated with 22 the edges of said guide) on the outer diameter 20 of the bobbin case 8 allows the angular reference of the bobbin case for the correct mounting of the bobbin case 8 in the basket 6, a possible post 23 into which the hole 24 of the shaft 25 (FIG. 2) of the bobbin case 8 is inserted;
- a race 10, formed in the inside wall of the cylindrical cavity 11 of the hook body 2 and delimited by two plane surfaces parallel with each other and by a cylindrical surface perpendicular to the plane ones, in which the rib 14 of the basket 6 engages to prevent the axial and radial translation of the basket 6 in the cylindrical cavity 11, but leaving it free to rotate;
- a bobbin case 8 housed in the well 18 of the basket 6, complete with latch slide 15 for the axial constraint of the bobbin case 8 on the basket 6 to prevent accidental disassembly during sewing, latch lever 16 that with the leverage created on latch slide 15 allows the operator to release the latch slide 15, and herewith the bobbin case 8, from its axial constraint on the basket 6, allowing the removal of the bobbin case 8, and with a tension spring 9 to give tension to the bobbin thread (of which the graphical representation is omitted) wound on the bobbin 4 housed inside the bobbin case 8. There is present also the guide 22 on the outer diameter 20 of the bobbin case 8 and parallel to the axis "α", which coupling with the projection 21 on the inner diameter 19 of the well 18 of the basket 6 allows the angular reference for the correct mounting of the bobbin case 8 in the basket 6. The mounting of the bobbin case 8 in the basket 6 occurs trough a free translation along the axis "α" of the bobbin case 8, at a coupling with play and after that guide 22 on the outer diameter 20 of the bobbin case 8 and parallel to the axis "α", has been rotated until the angular correspondence with the projection 21 on the inner diameter 19 of the well 18 of the basket 6; accidental disassembly is prevented by the axial constraint created by the latch slide 15 that engages on the basket 6;
- a bobbin 4, on which is wound the bobbin thread (not shown), is housed in the bobbin case 8 and is constrained inside the basket 6 by the mounting of the bobbin case 8 in the basket 6.

Figure 2:
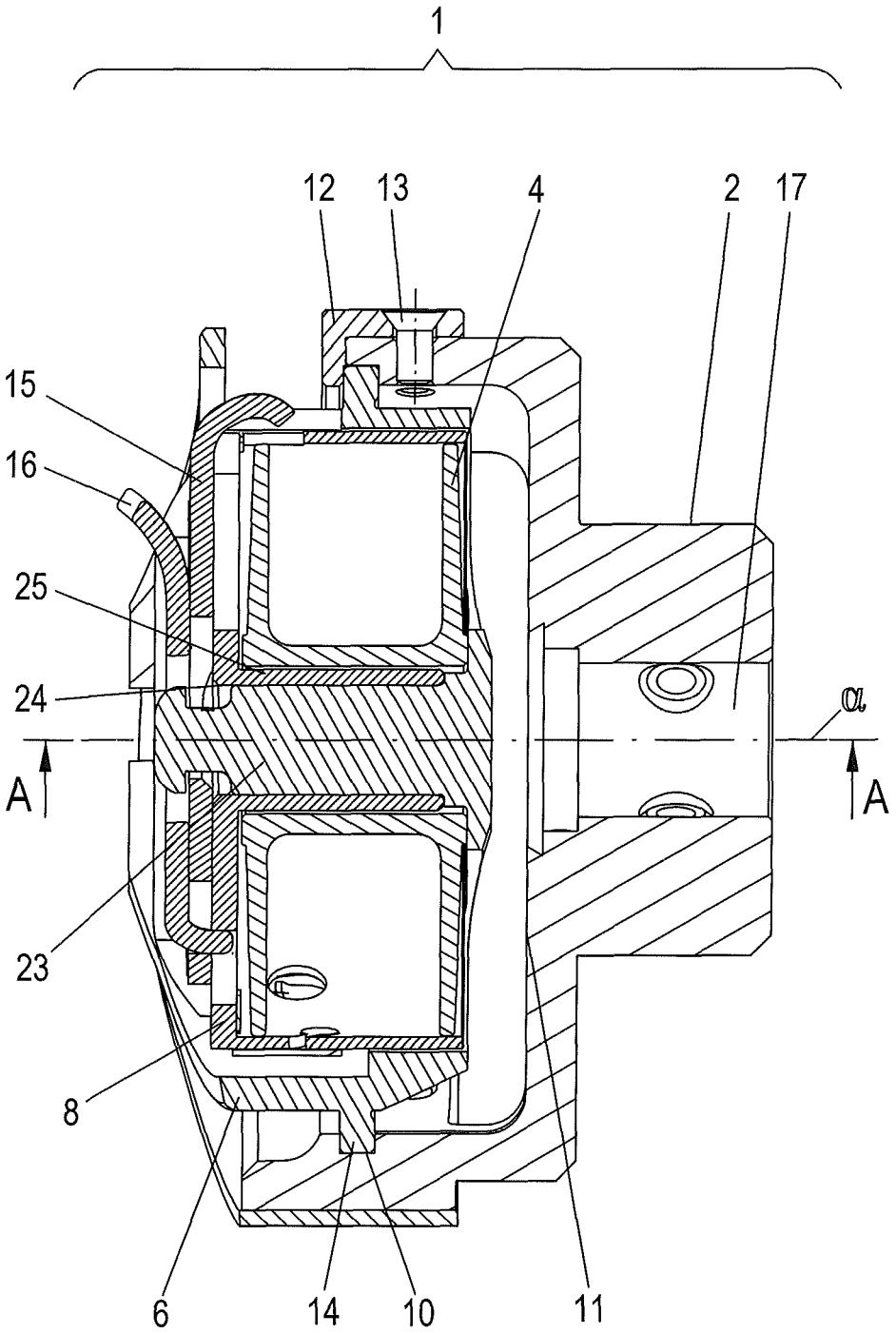
FIG. 2 shows schematically the rotary hook of FIG. 1 assembled and sectioned with a plane passing through its axis of rotation.
Figure 3:
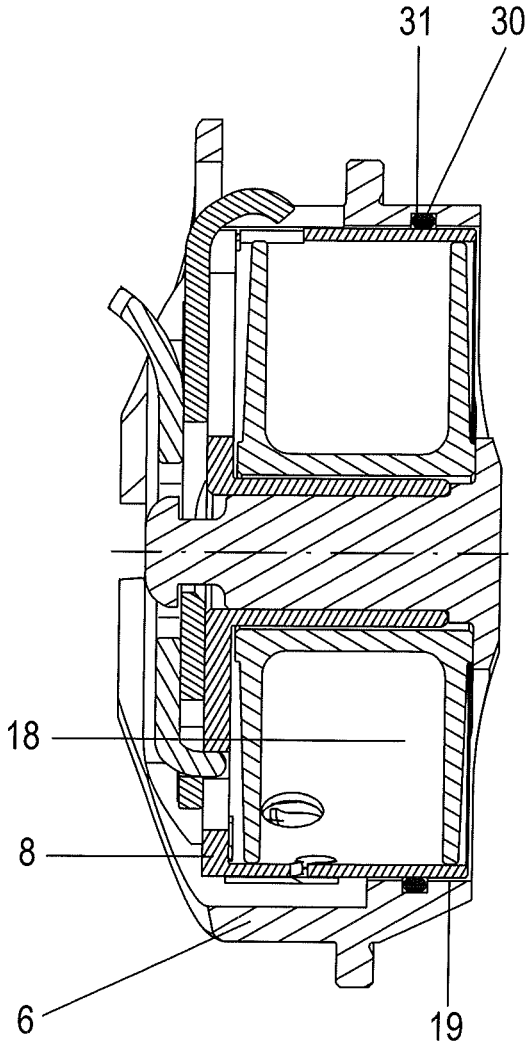
FIGS. 3-7 show schematically different embodiments of the basket of a rotary hook according to the invention, in which elastic means are provided which, when deformed by the mounting of the bobbin case, create a friction on the bobbin case to reduce the noise caused by the plays between the bobbin case and the basket.
Figure 4:
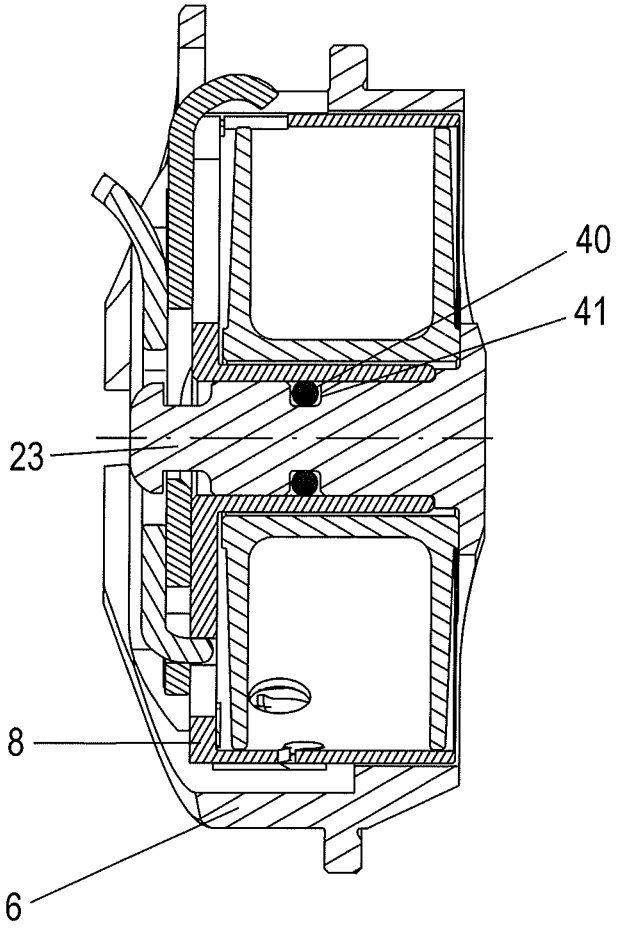
Figure 5:
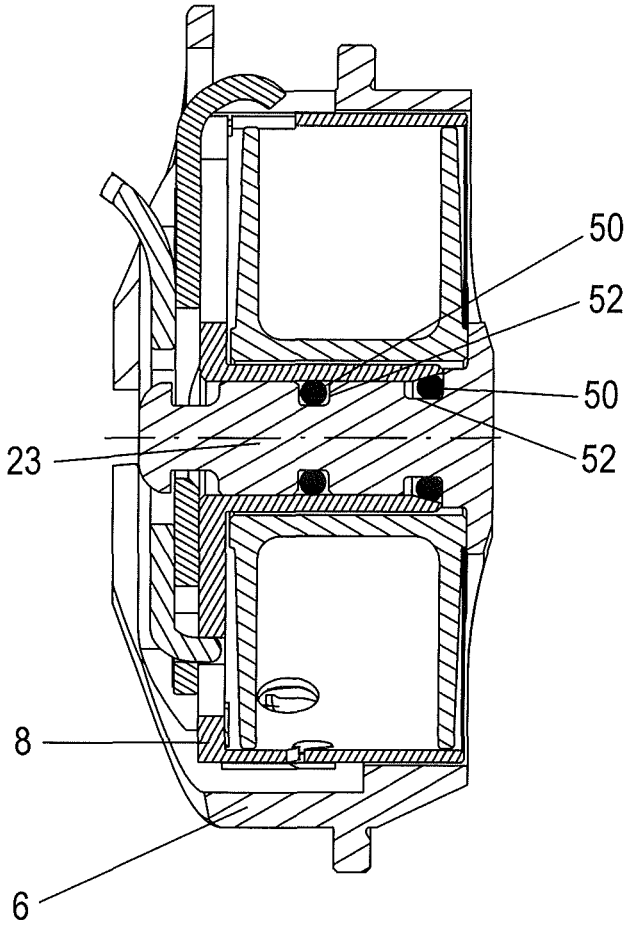
Figure 15:
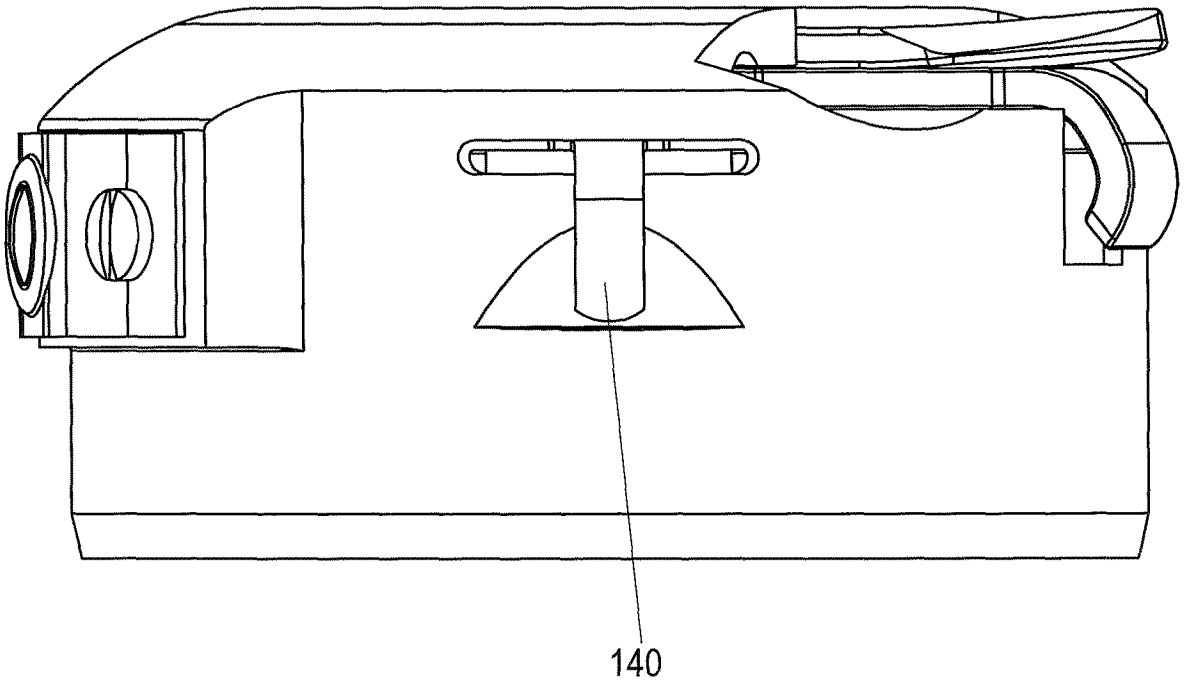
FIGS. 15, 17, 19 are side views of the bobbin case alone taken in the direction of the arrows B, C, D in FIGS. 14*a*, 16*a*, 18*a* respectively.

FIG. 2 shows schematically the rotary hook 1 of FIG. 1, of the prior art, assembled and sectioned through a plane passing through its axis of rotation "α"; visible in FIG. 2 are the hook body 2 comprising the cylindrical cavity 11, the rib 14 of the basket 6, the race 10 of the hook body in which the rib 14 of the basket 6 is engaged, and the central hole 17 of the cylindrical cavity 11 able to accommodate a shaft (omitted for the sake of simplicity of the graphic representation) from which the hook 1 receives motion; in a different embodiment, (not shown), on the other hand, the shaft can be also integral with the hook 1, further are also shown the bobbin case 8 and the bobbin 4. The same section used for FIG. 2, is also used for the other Figures, with the exception of FIGS. 7, 16 and 18, which are perpendicular and are made according to the section line A-A of FIG. 2. Finally, FIG. 15 is made on a section which in horizontal plan is slightly counter-clockwise rotated with respect to the section A-A, to show the elastic means in correspondence with the inner diameter 19 of the well 18 of the basket 6, where said diameter 19 is developed for its entire height, up to the top edge of the basket.

The rotary hook 1 object of the present invention comprises means suitable to create a friction between the bobbin case 8 and the basket 6, such as to annul the plays between bobbin case 8 and basket 6, preventing the consequent vibration and noisiness.

In a preferred embodiment of a rotary hook 1 according to the invention, schematically described in FIGS. 3-7 and 13, the means able to create such friction comprise at least one elastic means integral with the basket 6 of the hook 1, which can:

A) Be constituted by an annular elastic means 30 (in its most simple embodiment it is an O-ring) housed in a circular groove 31 formed in the inner diameter 19 of the well 18 of the basket 6 (FIG. 3), which is deformed while mounting the bobbin case 8 by the outer diameter 20 of said bobbin case 8. That elastic means 30 may have different shapes and be made from different materials. Such variations fall within the modifications of detail within the reach of competence of a person skilled in the art, without departing from the scope of the invention itself. By way of non-limiting example, some examples of realization of said elastic means are depicted in top view (FIG. 13), where the first (30*a*) can also be constituted by a well-known O-ring made of rubber, while the followings (30*b*, 30*c*, 30*d*, 30*e*) are possible alternative configurations of an elastic metal wire (preferably made of spring steel). Through appropriate form of said elastic means is also possible to realize protrusions (32) towards the outside , which, matching with appropriate niches on the diameter of the circular groove 31 on the inner diameter 19 of the well 18 of the basket 6, are constraining angularly said elastic means and prevent it from rotating inside said circular groove 31.

B) Be constituted by an annular elastic means 40 (in its most simple embodiment it is an O-ring) housed in a circular groove 41 formed in the post of the basket (FIG. 4) which is deformed while mounting the bobbin case 8 by the inner diameter of the hole 24 of the shaft 25 of said bobbin case 8.

C) Be constituted by two or more annular elastic means 50 (in the simplest realization they are O-rings) housed in respective circular grooves 52 formed in the post 23 of the basket 6 (FIG. 5) which are deformed while mounting the bobbin case 8 by the inner diameter of the hole 24 of the shaft 25 of said bobbin case 8.

Figure 6:
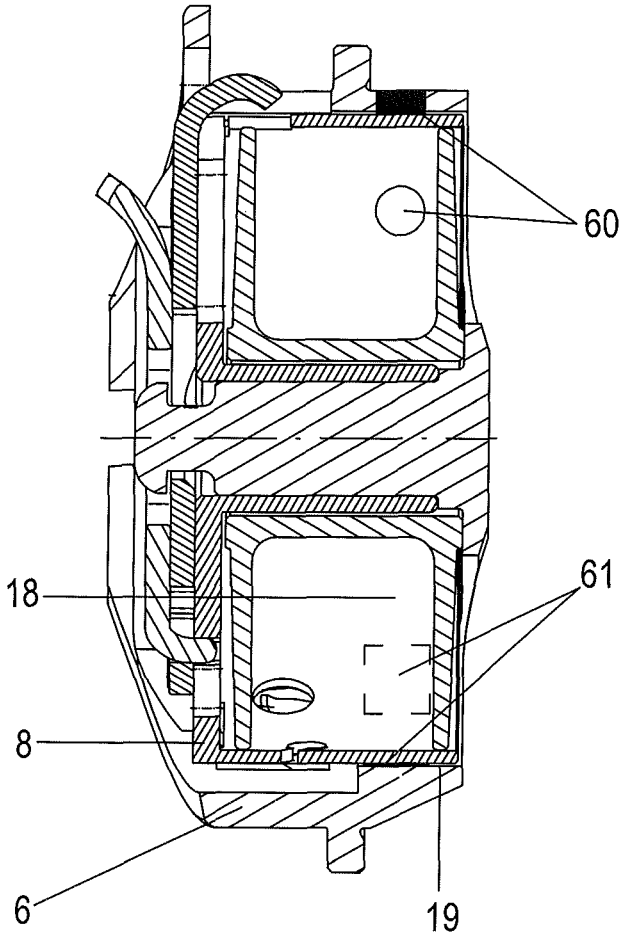

D) Be constituted by one or more means 60, 61 of material that is elastic to compression and fixed (for example, stuck or glued or affixed as coating) on the inner diameter 19 of the well 18 of the basket 6, which are deformed while mounting the bobbin case 8 by the outer diameter 20 of said bobbin case. In FIG. 6 are represented, by way of example, but not limiting, respectively two cylindrical means 60 embedded in respective seats formed on the inner diameter 19 of the well 18 of the basket 6 and two means of elastic material of rectangular shape 61 glued on the inner diameter 19 of the well 18 of the basket 6.

Figure 7:
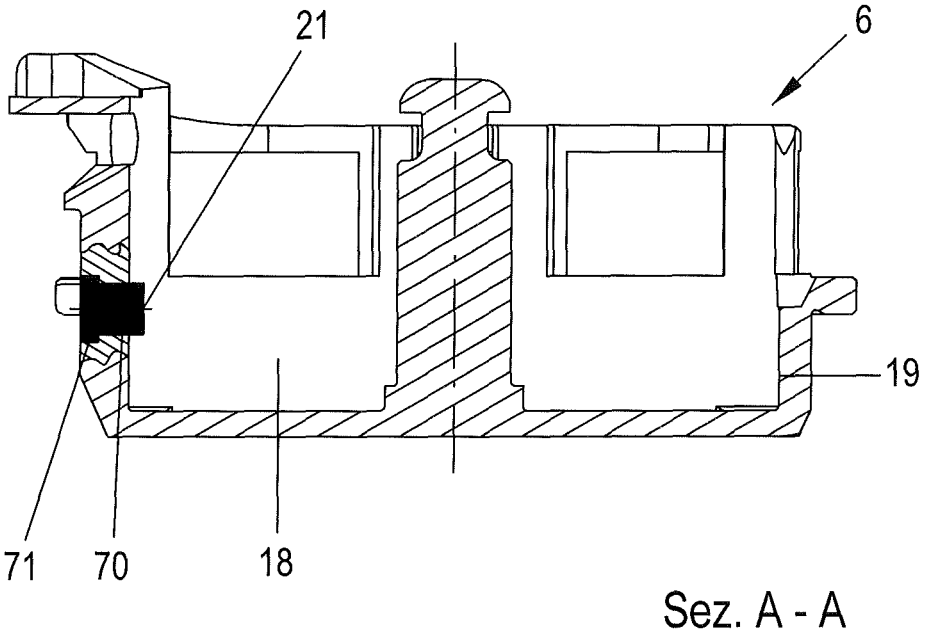

E) Be constituted by one or more means 70 of material that is elastic to compression and which go to constitute a projection 21 on the inner diameter 19 of the well 18 of the basket 6 for the angular coupling with the guide 22 on the outer diameter 20 of the bobbin case 8, which are deformed while mounting the bobbin case 8 by the edges of said guide 22 on the outer diameter 20 of the bobbin case 8. FIG. 7 represents a section A-A (see FIG. 2) perpendicular to that used for all other FIGS. 2-6 and 8-13.

Figure 8:
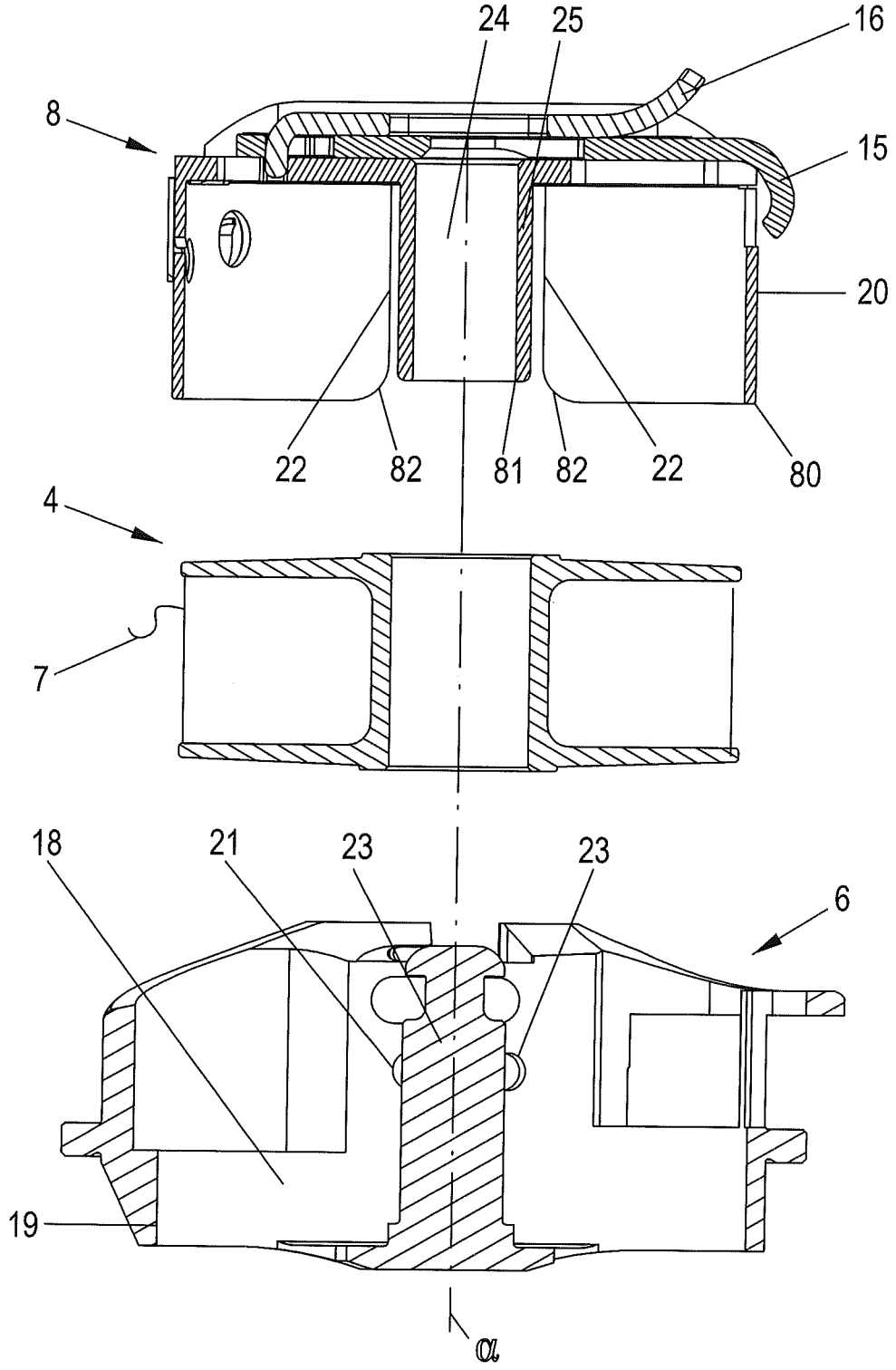
FIG. 8 shows schematically the bobbin case and the basket of the rotary hook of FIG. 1, of the prior art, disassembled and sectioned with a plane passing through the axis of rotation of the hook.

In another preferred embodiment of a rotary hook 1 according to the invention, the means for creating such friction comprise at least one elastic means integral with the bobbin case 8 of the hook 1. Said at least one elastic means integral with the bobbin case 8 can be constituted by one or more means 60 of material that is elastic to compression and fixed (for example, stuck or glued or affixed as coating) on the outer diameter 20 of the bobbin case 8, which are deformed while mounting the basket 6 by the inner diameter 19 of the well 18 of the basket 6. In FIG. 6 is represented, by way of example, but not limiting, a means of elastic material of rectangular shape 61 glued on the outer diameter 20 of the bobbin case 8 (it is the same graphical representation as already previously used, for the fact that the same means can either be glued on the inner diameter 19 of the well 18 of the basket 6 or on the outer diameter 20 of the bobbin case 8). In another preferred embodiment of a rotary hook 1 according to the invention, said at least one elastic means integral with the bobbin case 8 can be constituted by a coating of non-metallic material of the entire bobbin case 8 or only the outer diameter 20 of the bobbin case 8 for its entire circumference and throughout its development in height , or even of only a portion of the outer diameter 20 of the bobbin case 8 , formed by the development for the whole circumference of only a portion of the height, preferably comprising the lower edge 80 (FIG. 8). This latter embodiment can be easily obtained by partial immersion of the bobbin case in the coating bath and also brings with it the advantage of covering also part of the inner diameter of the bobbin case 8 in the area where it is coupled with the bobbin 4, thereby reducing the noise generated also by the play between bobbin case 8 and bobbin 4.

In other embodiments FIGS. 14-19, said at least one elastic means integral with the bobbin case 8 can be constituted by one or more elastic means protruding from the outer diameter 20 of the bobbin case 8, which are deformed while mounting the bobbin case 8 by the inner diameter 19 of the well 18 of the basket 6 or by a niche formed in said inner diameter 19.

Figures 14A, 14B:
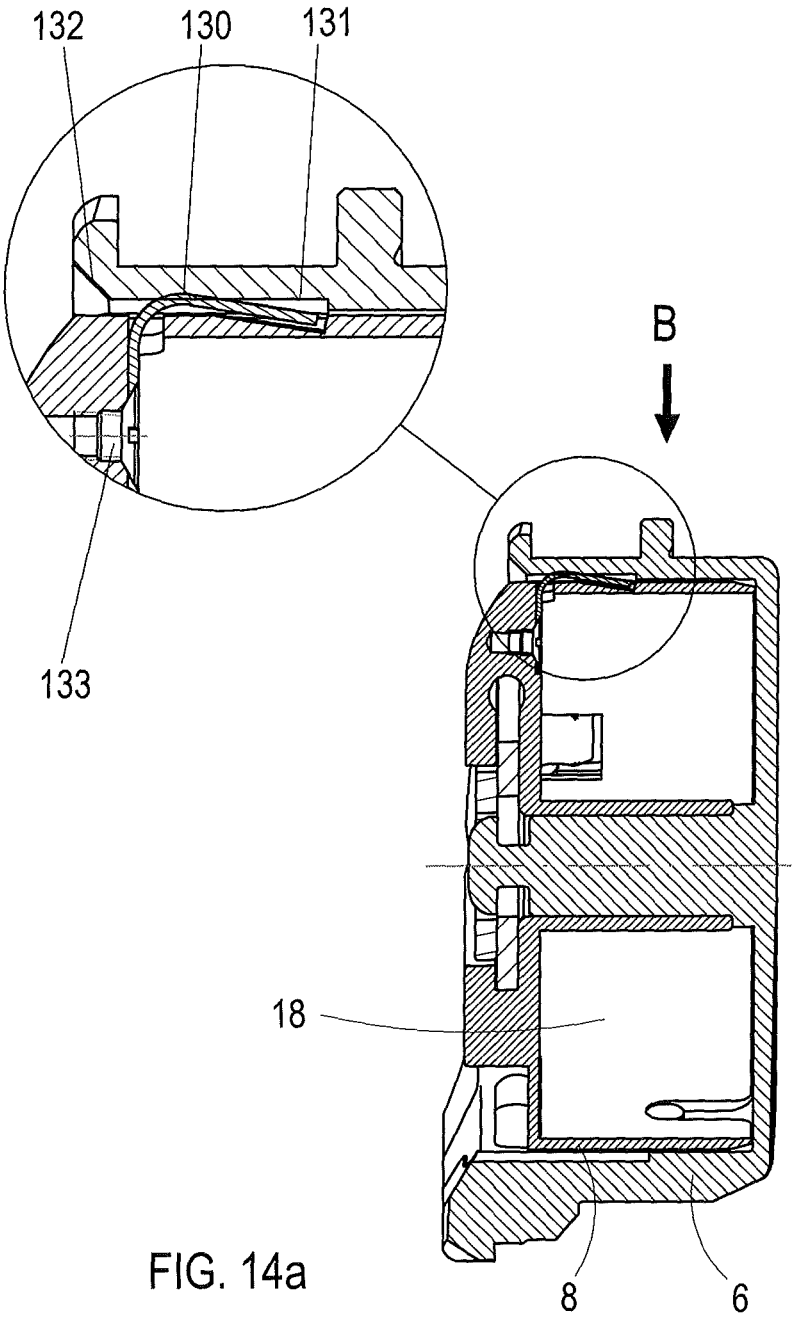
FIGS. 14*a*, 16*a*, 18*a* are sectional views of the basket with bobbin case.
FIGS. 14*b*, 16*b*, 18*b* are enlargements of details enclosed in a circle in the respective previous Figures.

FIG. 14 shows in section, by way of example, but not limiting, an elastic means 130 (for example of metal sheet) that is fixed to the bobbin case 8 (for example by a screw 133) and protrudes from the outer diameter 20 of the bobbin case 8 and creates a pressure on the inner diameter 19 of the well 18 of the basket 6 or on a niche 131 formed in said inner diameter 19, and which is facilitated during the mounting operation by a chamfer 132 realized on the top edge of the inner diameter 19 of the well 18 of the basket 6. FIG. 15 shows the sole bobbin case 8 (without basket 6) in the same embodiment in a side view from B, as shown in FIG. 14.

In other embodiments, said at least one elastic means integral with the bobbin case 8 can be constituted by one or more elastic means made of a single piece on the outer diameter 20 of the bobbin case, which are possibly equipped with a protrusion from said outer diameter 20 of the bobbin case and which are deformed while mounting the bobbin case 8 by the inner diameter 19 of the well 18 of the basket 6 or by a niche formed in said inner diameter 19.

Figures 16A, 16B:
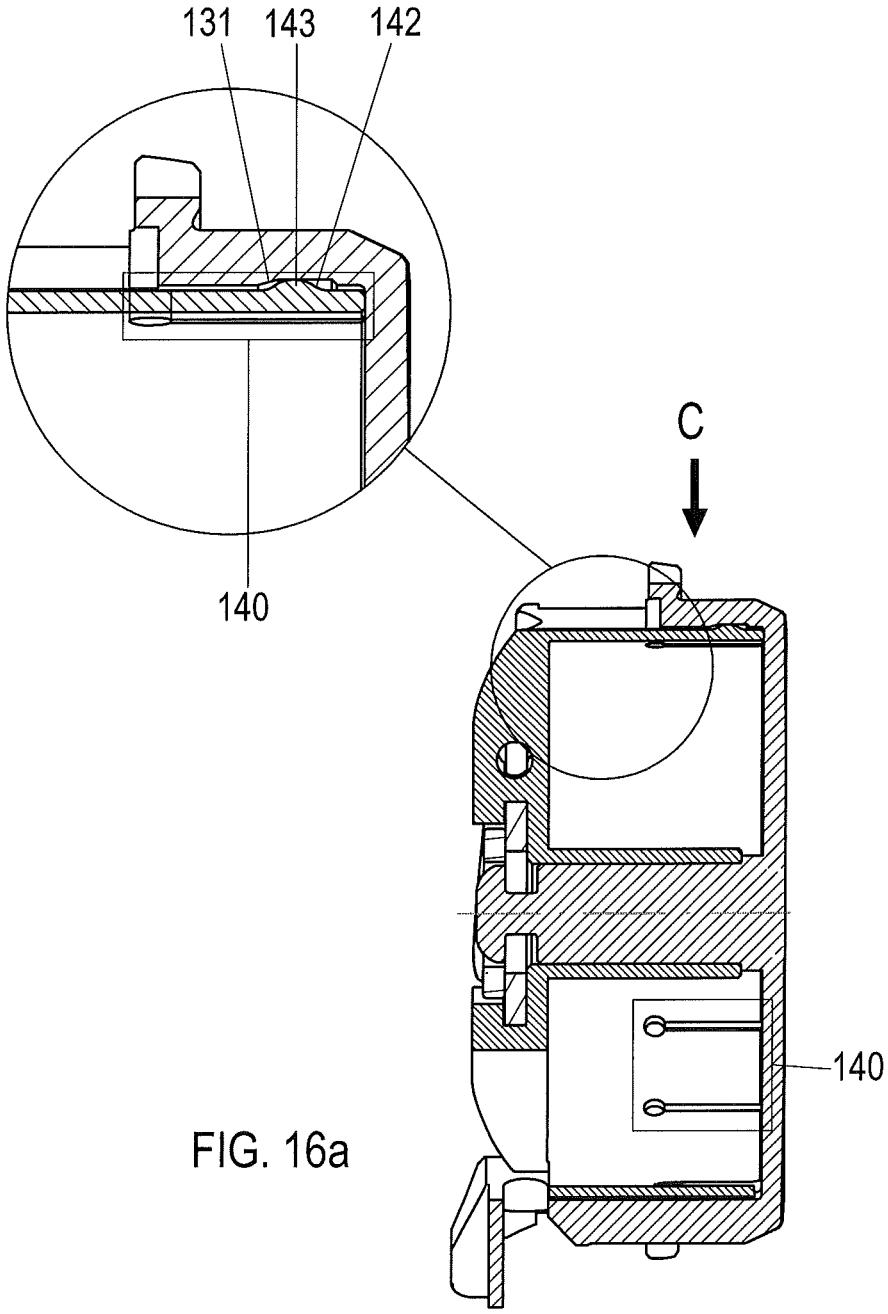
Figure 17:
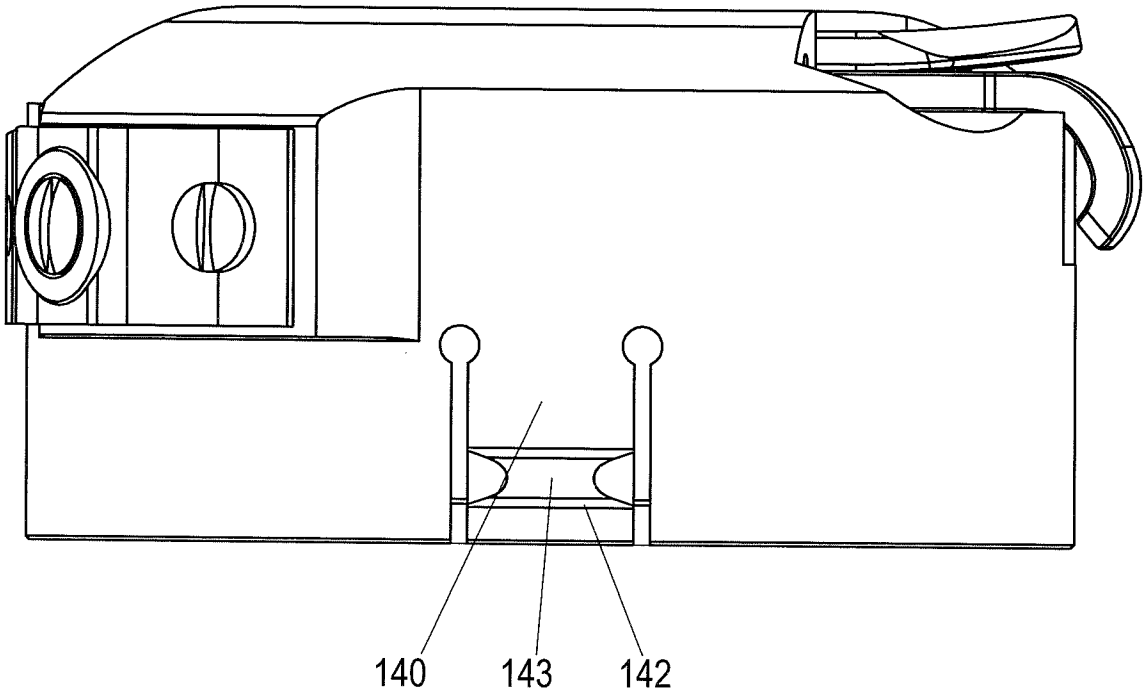

FIG. 16 shows in section, by way of example, but not limiting, an elastic means 140 made of a single piece on the outer diameter 20 of the bobbin case 8, 8*b*, which comprises a protrusion 143 from the outer diameter 20 of the bobbin case 8, which creates a pressure on the inner diameter 19 of the well 18 of the basket 6 or on a niche 141 that is formed in said inner diameter 19 and is facilitated in the mounting by a chamfer 142 made on the protrusion 143 on the outer diameter 20 of the bobbin case 8. FIG. 17 shows the sole bobbin case 8 (without basket 6) in the same embodiment in a side view from C, as indicated in FIG. 16.

Figure 10:
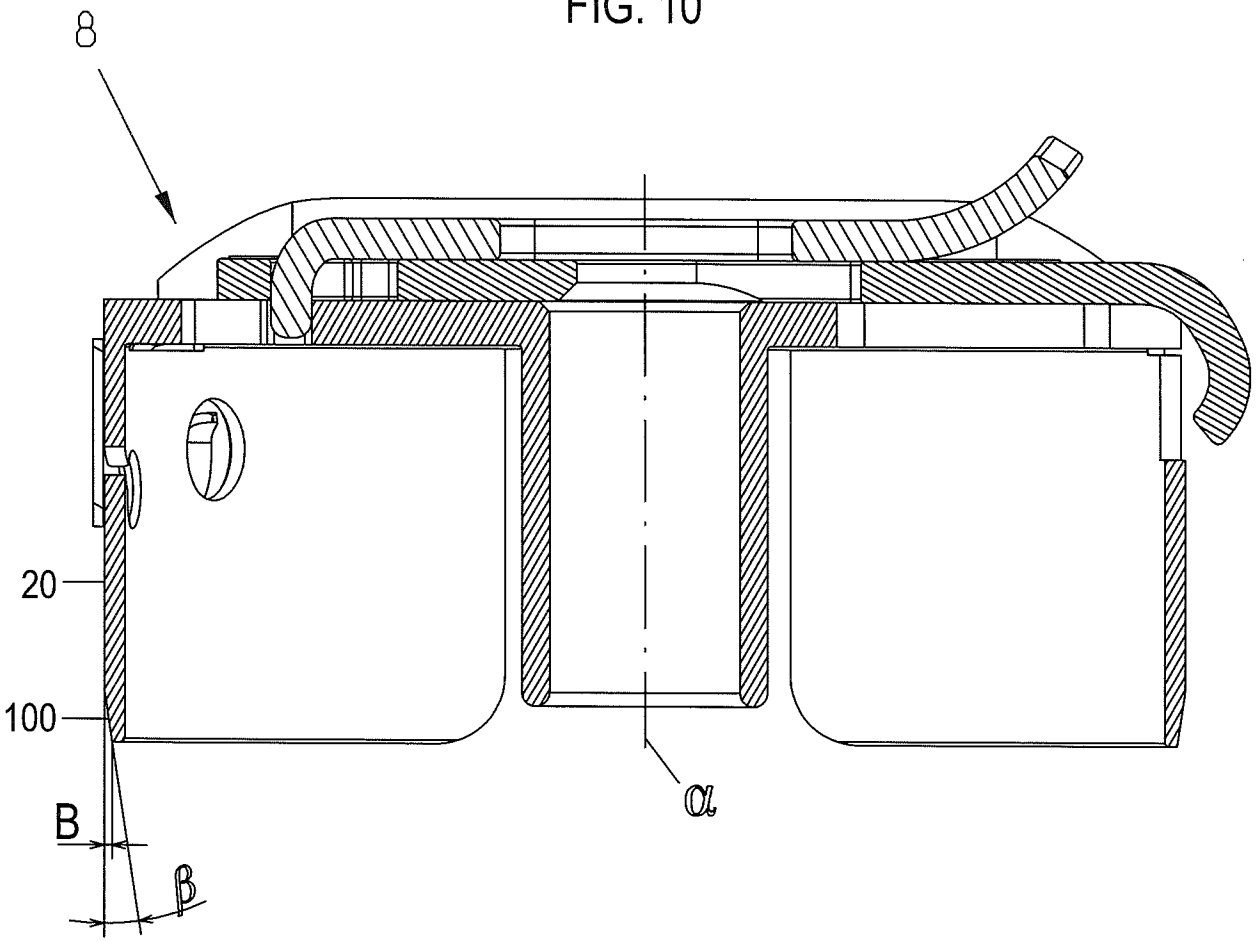
FIG. 10 shows schematically a different embodiment of the bobbin cases of FIGS. 8 and 9 according to the invention, wherein there is provided a chamfer to facilitate the deformation of the elastic means during the mounting of the bobbin case in the basket, when this means is in correspondence with the inner diameter of the well of the basket.
Figures 18A, 18B:
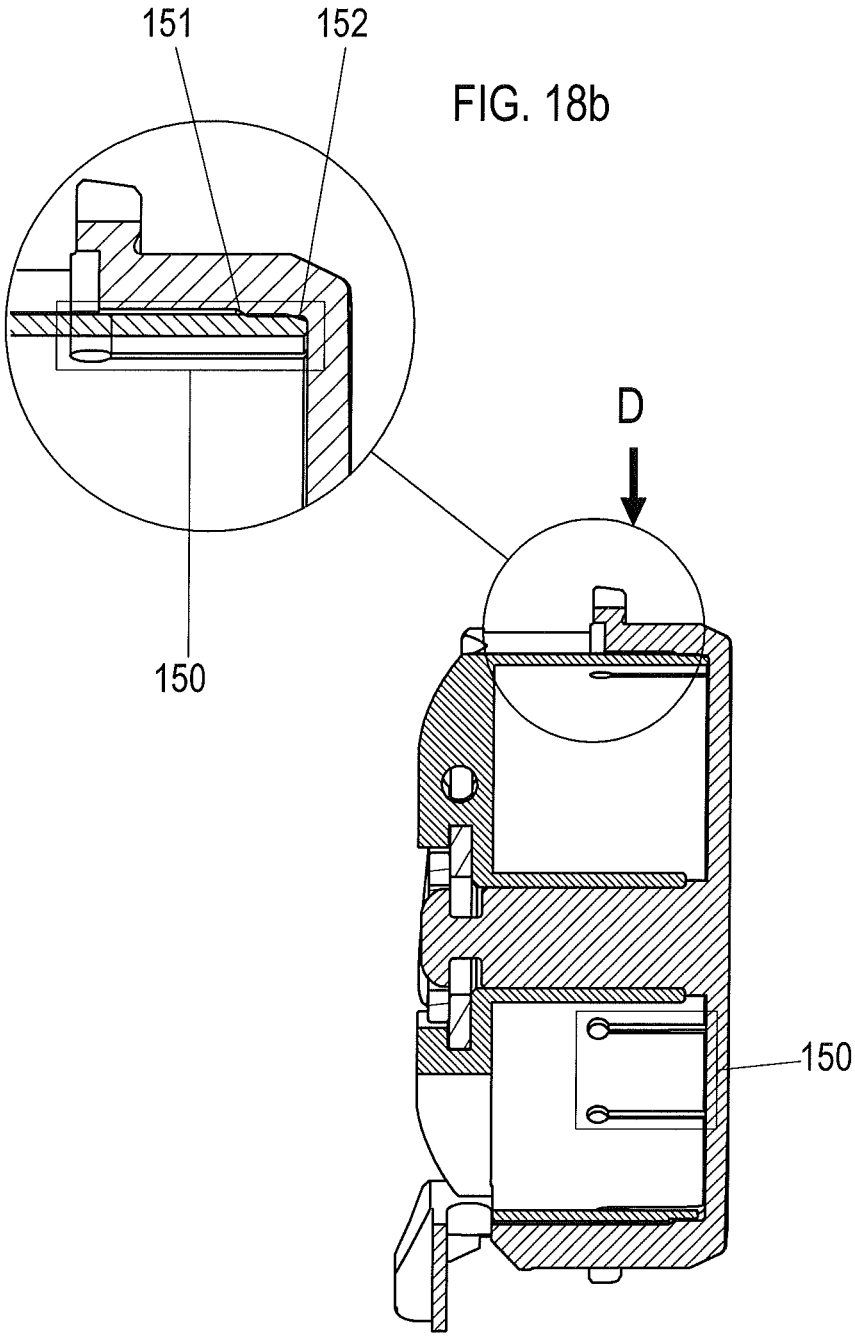
Figure 19:
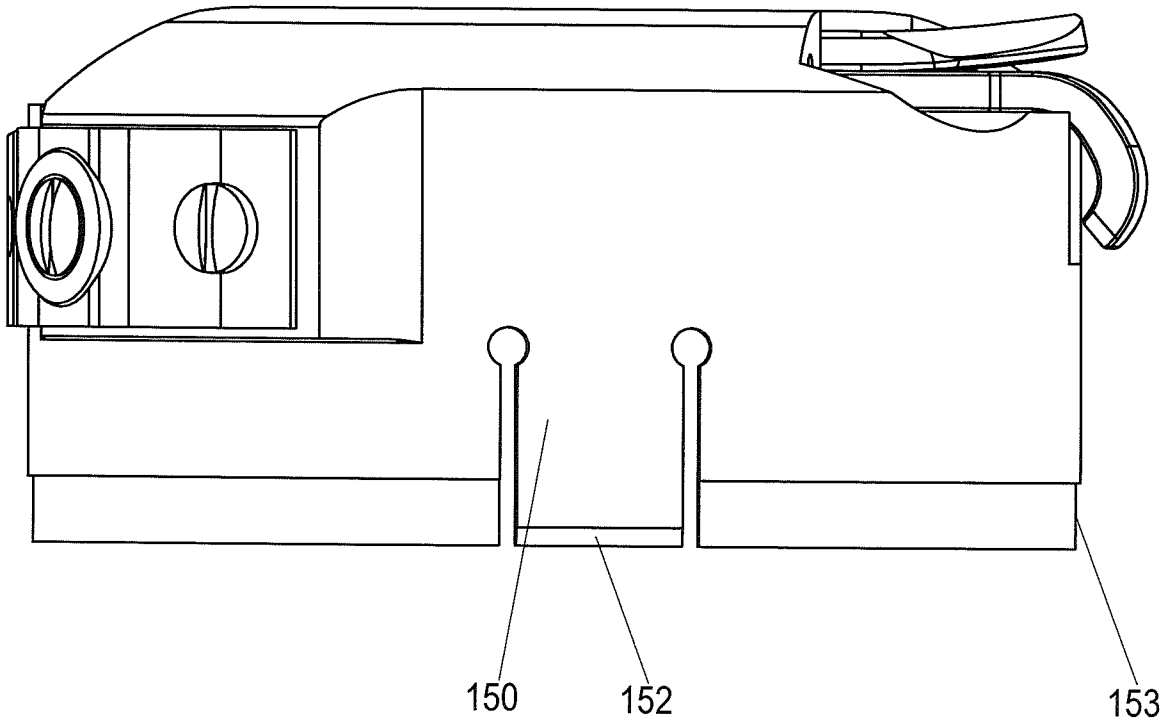

FIG. 18 shows in section, by way of examples, but not limiting, more elastic means 150 made in a single piece on the outer diameter 20 of the bobbin case 8, which create a pressure on a protrusion 151 formed on the inner diameter 19 of the well 18 of the basket 6 and which are facilitated in the mounting by a chamfer 152 made on the outer diameter 20 of the bobbin case 8 and similar to that of FIG. 10. For simplicity of construction it is possible to realize the protrusion 151 on the inner diameter 19 of the well 18 of the basket 6 in circular form (i.e. for the entire development of the diameter 19) and make an relief 153 on the outer diameter 20 of the bobbin case 8 for the whole arc of circumference where the elastic means 150 are not present. FIG. 19 shows the sole bobbin case 8 (without basket 6) in the same embodiment in a side view from D, as shown in FIG. 18.

FIG. 8 shows schematically the only sub-assembly 5 of the rotary hook 1 of FIG. 1, of the prior art, sectioned on the same plane passing through the axis of rotation "α" as in FIG. 2. There are visible:

the basket 6 comprising a well 18 of the basket 6 suited to accommodate the bobbin case 8 complete with bobbin 4, an inner diameter 19 defining said well 18 of the basket 6 in which fits the outer diameter 20 of the bobbin case 8, a projection 21 on the inner diameter 19 of the well 18 of the basket 6, which coupling with the guide 22 on the outer diameter 20 of the bobbin case 8, allows the reference angle of the bobbin case 8 for the correct mounting of the bobbin case 8 in the basket 6, a post 23 onto which the hole 24 of the shaft 25 of the bobbin case 8 is inserted;

a bobbin case 8, complete with latch slide 15 and latch lever 16 and comprising an outer diameter 20 with a lower edge 80, a guide 22 on the outer diameter 20 of the bobbin case 8 and parallel to the axis "α", that coupling with the projection 21 on the inner diameter 19 of the well 18 of the basket 6 allows the angular reference for the correct mounting of the bobbin case 8 in the basket 6, two radiuses 82 on the corner between the edges of the guide 22 and the lower edge 80 of the outer diameter 20 of the bobbin case 8 to facilitate the angular coupling, a shaft 25 with a coaxial hole 24 and a lower edge 81 of said hole 24;

a bobbin 4, on which is wound the bobbin thread 7, that must be housed in the bobbin case 8 and is then constrained inside the basket 6 by the mounting of the bobbin case 8 in the basket 6.

Figure 9:
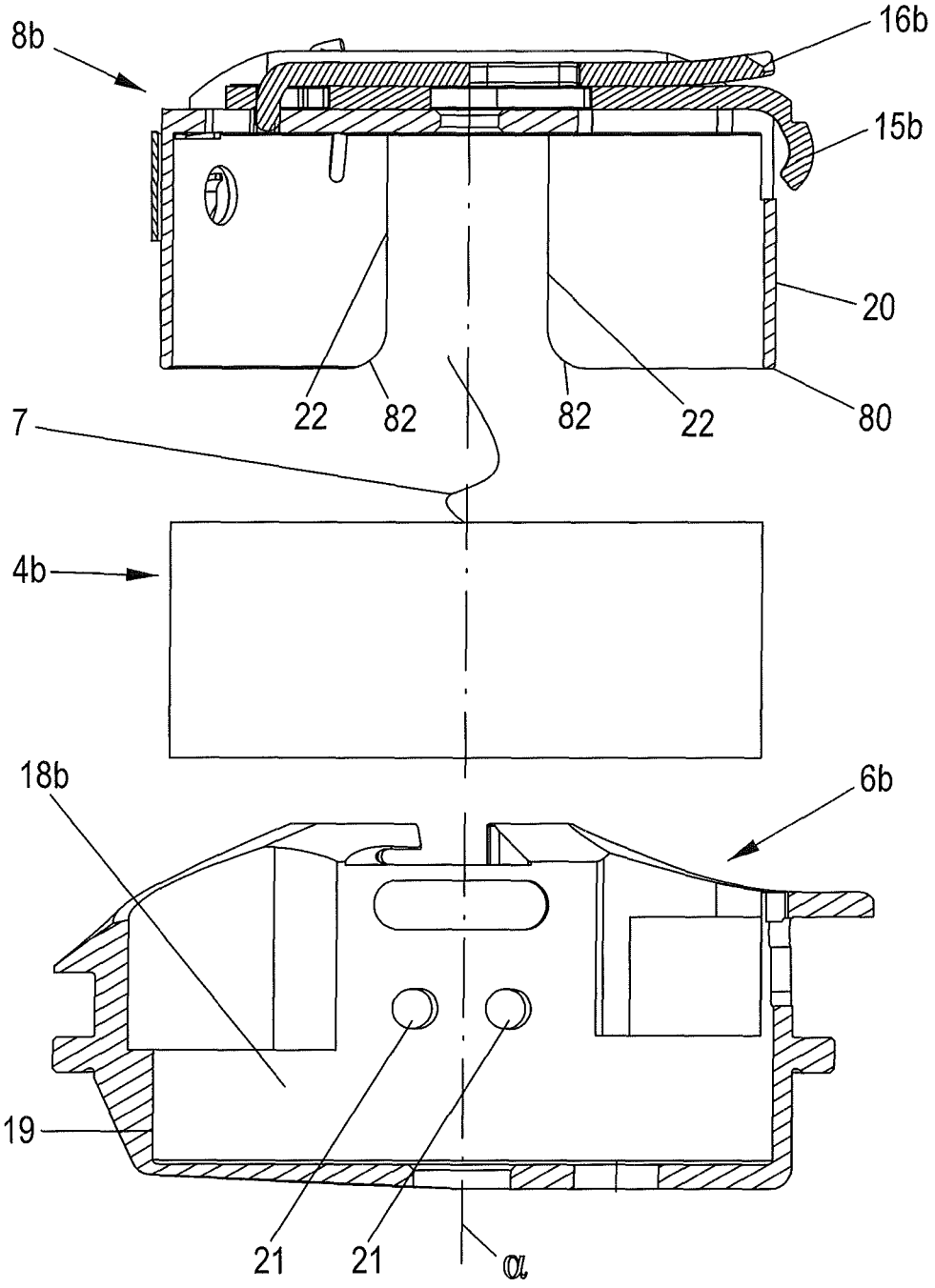
FIG. 9 shows schematically another embodiment of the bobbin case and the basket of the rotary hook of FIG. 1 for bobbins without central hole, of the prior art, disassembled and sectioned with a plane passing through the axis of rotation of the hook.

FIG. 9, like the previous FIG. 8, schematically shows only the sub-assembly 5 of the rotary hook 1 of FIG. 1, but this time in execution, also of the prior art, for bobbins 4*b* without central hole, sectioned on the same plane passing through the axis of rotation "α" as in FIG. 2. These bobbins 4*b* of the prior art, are generally composed of only pre-wound and compacted bobbin thread 7, thus not needing a metallic or synthetic core. The exiting of the bobbin thread 7 from the bobbin 4*b* occurs in general axially, rather than tangentially as for traditional bobbins 4.

In FIG. 9 are visible:

The basket 6*b* comprising a well 18 of the basket 6*b* suited to house the bobbin case 8*b* complete with bobbin 4*b*, an inner diameter 19 delimiting said well 18 of the basket 6*b* in which fits the outer diameter 20 of the bobbin case 8*b*, a projection 21 on the inner diameter 19 of said well 18 of the basket 6*b*, which coupling with the guide 22 on the outer diameter 20 of the bobbin case 8*b* allows the angular reference of the bobbin case 8*b* for the correct mounting of the bobbin case 8*b* in the basket 6*b*;

a bobbin case 8*b*, complete with latch slide 15 and latch lever 16 and comprising an outer diameter 20 with a lower edge 80, a guide 22 on the outer diameter 20 of the bobbin case 8*b* and parallel to the axis "α", that coupling with the projection 21 on the inner diameter 19 of the well 18 of the basket 6*b* allows the angular reference for the correct mounting of the bobbin case 8*b* on the basket 6*b*, two radiuses 82 on the corner between the edges of the guide 22 and the lower edge 80 of the outer diameter 20 of the bobbin case 8*b* to facilitate the angular coupling;

a bobbin 4*b*, consisting of pre-wound and compacted bobbin thread 7, thus not needing a metal or synthetic core, which must be housed in the bobbin case 8*b* and is then constrained inside the basket 6*b* by the mounting of the bobbin case 8*b* in the basket 6*b*.

In the case of baskets 6*b* and bobbin cases 8*b* of the prior art without post 23 and shaft 25 respectively, used to accommodate bobbins 4*b* without central hole, the embodiments of the invention described above, which include elastic means placed on the post 23 (see FIGS. 4 and 5), which is missing in the basket 6*b*, are clearly excluded, but all other embodiments remain valid and applicable, including those of FIGS. 14-19.

Figure 11:
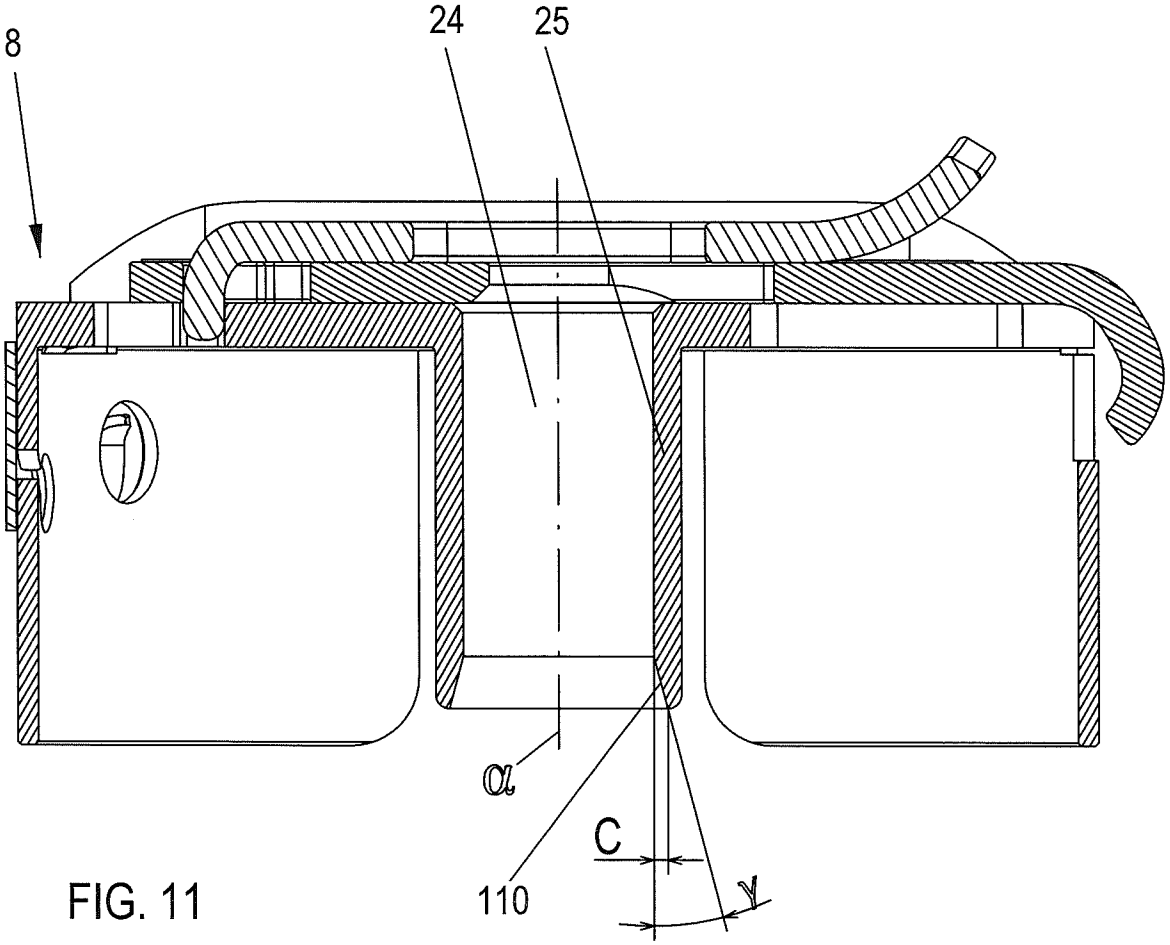
FIG. 11 shows schematically a different embodiment of the bobbin case capsule of FIG. 8 according to the invention, wherein there is provided a chamfer to facilitate the deformation of the elastic means during the mounting of the bobbin case in the basket, when this means is in correspondence with the post of the basket.
Figure 12:
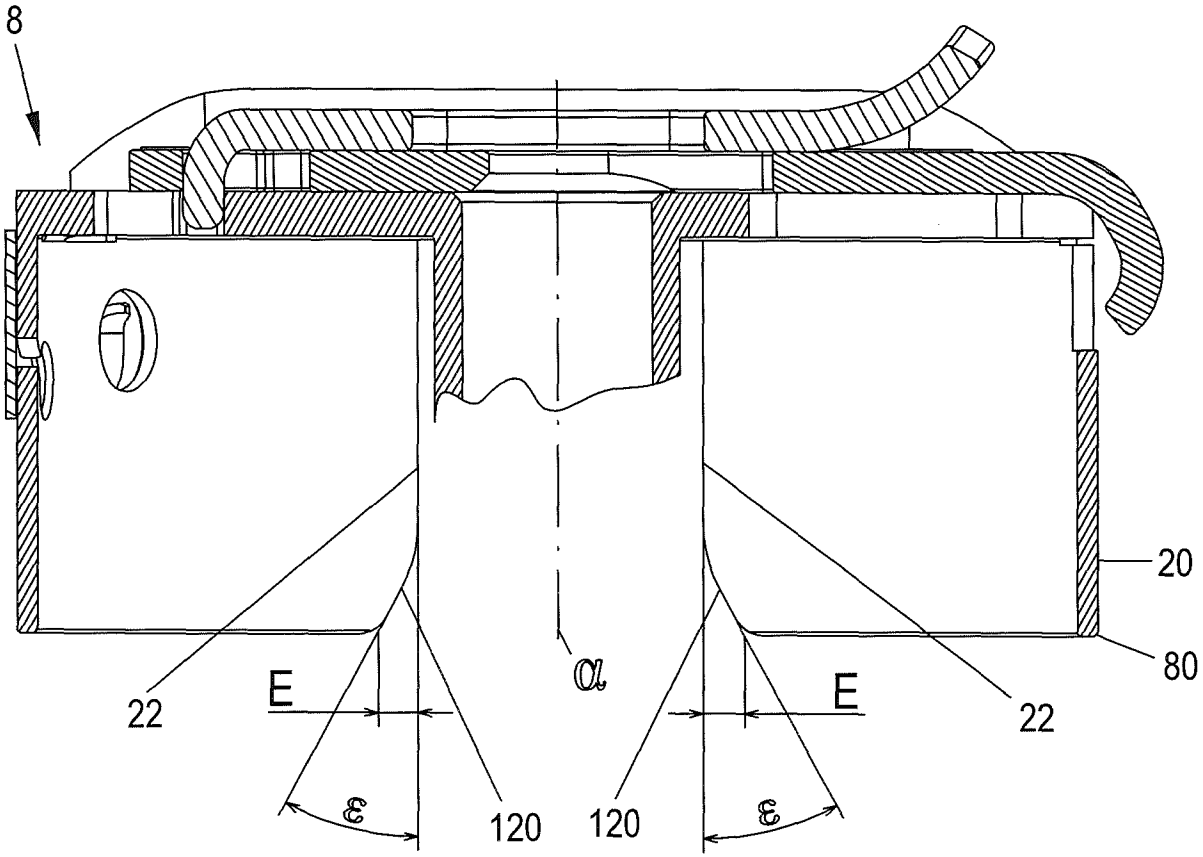
FIG. 12 shows schematically a different embodiment of the bobbin case of FIGS. 8 and 9 according to the invention, wherein there is provided a chamfer to facilitate the deformation of the elastic means during the mounting of the bobbin case in the basket, when this means is constituted by the projection on the inner diameter of the well of the basket, which cooperates with the guide, parallel to the axis of the hook, formed on the outer diameter of the bobbin case, for the correct angular reference for the mounting of the bobbin case in the basket.
Figure 13:
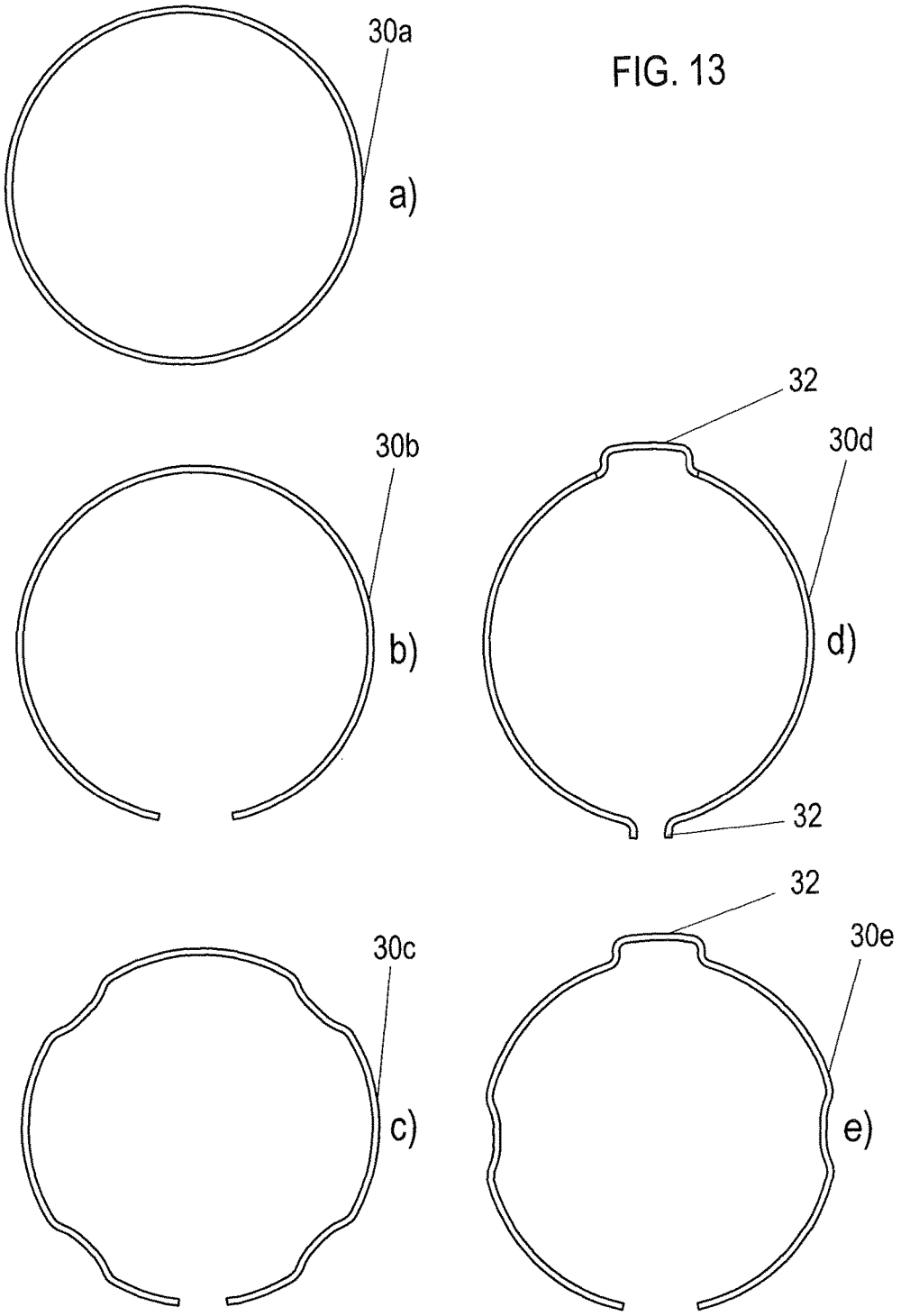
FIG. 13*a*)-*e*) shows in top view some possible embodiments of the elastic means represented in section in FIG. 3.

To facilitate mounting the bobbin case 8, 8*b* in the presence of elastic means (30, 40, 50, 51, 60, 61, 70, 130, 140, 150) and to facilitate the gradual deformation of said elastic means, different preferred embodiments of a bobbin case 8, 8*b* of a rotary hook 1 according to the invention, schematically described in FIGS. 10-12 and 14-19, comprise at least one chamfer 100-110-120 and respectively 142-152 (already described):

in FIG. 10, the chamfer 100 is realized on the lower edge 80 of the outer diameter 20 of the bobbin case 8 for the deformation of the elastic means (30, 60, 61) located on the inner diameter 19 of the well 18 of the basket 6; in a preferred embodiment, said chamfer is formed by a bevel characterized by an angle β with respect to the generatrix of the outer diameter 20 of the bobbin case 8 and by a cathetus B perpendicular to the generatrix of the outer diameter 20 of the bobbin case 8. In a preferred embodiment, said angle β of the bevel is between 5° and 20°. In a preferred embodiment, said cathetus B of the bevel is at least greater than 0.2 mm;

in FIG. 11 the chamfer 110 is realized on the lower edge 81 of the hole 24 of the shaft 25 of the bobbin case 8 for the deformation of the elastic means (40, 50, 51) located on the post 23 of the basket 6; in a form of preferred embodiment, said chamfer is made by a bevel characterized by an angle y with respect to the generatrix of the hole 24 of the bobbin case 8 and a cathetus C perpendicular to the generatrix of the hole 24 of the bobbin case 8. In a preferred embodiment, said angle y of the bevel is between 5° and 20°. In a preferred embodiment, said cathetus C of the bevel is at least greater than 0.2 mm;

In FIG. 12 the chamfer 120 is realized at the place of the radiuses 82 on the corner between the edges of the guide 22 and the lower edge 80 of the outer diameter 20 of the bobbin case 8 for the deformation of the elastic means (70) of the basket 6 that goes to constitute a projection 21 on the inner diameter 19 of the well 18 of the basket 6; in a preferred embodiment, said chamfer is constituted by a bevel or by a bevel rounded at the ends, characterized by an angle g with respect to the edges of the guide 22 of the bobbin case 8 and by a cathetus E perpendicular to the edges of the guide 22. In a preferred embodiment, said angle g of the bevel is between 5° and 20°. In a preferred embodiment, said cathetus E perpendicular to the edges of the guide is at least greater than 0.5 mm.

In the case of baskets 6*b* and bobbin cases 8*b* of the prior art without post 23 and shaft 25 respectively, used to accommodate bobbins 4*b* without central hole, the embodiments of the invention described above, which include elastic means placed on the post 23, which is missing in the basket 6*b*, and the relative chamfers on the shaft 25, which is missing in the bobbin case 8*b*, are clearly excluded. In the case of baskets 6*b* and bobbin cases 8*b*, of the prior art without post 23 and shaft 25 respectively, the preferred embodiments are therefore respectively the one with the chamfer 100 realized on the outer diameter 20 of the bobbin case 8*b* for the deformation of the elastic means (30, 60, 61) placed on the inner diameter 19 of the well 18 of the basket 6*b* (FIG. 10), the one with the chamfer 120 realized on the corner between the edges of the guide 22 and the lower edge 80 of the outer diameter 20 of the bobbin case 8*b* for the deformation of the elastic means (70) of the basket 6*b* which constitute the projection 21 on the inner diameter 19 of the well 18 of the basket 6*b* (FIG. 12), the one with the chamfer 132 realized on the top edge of the inner diameter 19 of the well 18 of the basket 6 (or 6*b*) for the deformation of the elastic means (130) realized on the outer diameter 20 of the bobbin case 8 (or 8*b*) (FIGS. 14-15), the one with the chamfer 142 made on the protrusion 143 on the outer diameter 20 of the capsule 8 (or 8*b*) for the deformation of the elastic means (140) realized on the outer diameter 20 of the bobbin case 8 (or 8*b*) (FIGS. 16-17) and the one with the chamfer 152 realized on the outer diameter 20 of the bobbin case 8 (or 8*b*) for the deformation of the elastic means (150) realized on the outer diameter 20 of the bobbin case 8 (or 8*b*) (FIGS. 18-19).

Naturally, the invention is not limited to the particular embodiments previously described and illustrated in the accompanying figures, but it can be subject to numerous modifications of detail within the reach of a person skilled in the art, without departing from the scope of the invention itself, as defined in the appended claims.

The invention claimed is:

1. A rotary hook (1) for a lockstitch sewing machine, comprising:

a hook body (2), which includes a cylindrical cavity (11), the hook body (2) being connected to a shaft from which the hook body receives motion;

a basket, which is free to rotate inside the cylindrical cavity (11) of the hook body (2);

a bobbin case that collaborates with the basket to constrain a bobbin on which is wound the bobbin thread (7); and at least one annular spring configured to create a friction between the bobbin case and the basket so as to prevent the bobbin case from moving and freely vibrating within plays present between the bobbin case and the basket in order to reduce, during sewing, noise caused by said plays, wherein said at least one annular spring is fixed with respect to the basket and is housed in a circular groove realized in an inner diameter (19) of a well (18) of the basket.

2. The rotary hook (1) as per claim 1, wherein said bobbin case has at least one chamfer that facilitates mounting the bobbin case in the basket in the presence of said at least one annular spring, and facilitates a gradual deformation of the at least one annular spring, and wherein said at least one chamfer is realized on a lower edge (80) of an outer diameter (20) of the bobbin case for the deformation of the at least one annular spring.

3. A rotary hook (1) for a lockstitch sewing machine, comprising:

a hook body (2), which includes a cylindrical cavity (11), the hook body (2) being connected to a shaft from which the hook body receives motion;

a basket, which is free to rotate inside the cylindrical cavity (11) of the hook body (2);

a bobbin case that collaborates with the basket to constrain a bobbin on which is wound the bobbin thread (7); and at least one annular spring configured to create a friction between the bobbin case and the basket so as to prevent the bobbin case from moving and freely vibrating within plays present between the bobbin case and the basket in order to reduce, during sewing, noise caused by said plays, wherein said at least one annular spring is fixed with respect to the basket and is housed in a circular groove realized in a post (23) with which the basket is provided.

4. The rotary hook (1) as per claim 3, wherein said bobbin case has at least one chamfer that facilitates mounting the bobbin case in the basket in the presence of said at least one annular spring, and facilitates a gradual deformation of the at least one annular spring, and wherein said at least one chamfer is realized on a lower edge (81) of a hole (24) of the shaft for the deformation of the at least one annular spring.

5. A lockstitch sewing machine, comprising:

a rotary hook (1), which includes a hook body (2), which includes a cylindrical cavity (11), the hook body (2) being connected to a shaft from which the hook body receives motion;

a basket, which is free to rotate inside the cylindrical cavity (11) of the hook body (2);

a bobbin case that collaborates with the basket to constrain a bobbin on which is wound the bobbin thread (7); and at least one annular spring configured to create a friction between the bobbin case and the basket so as to prevent the bobbin case from moving and freely vibrating within plays present between the bobbin case and the basket in order to reduce, during sewing, noise caused by said plays, wherein said at least one annular spring is fixed with respect to the basket and is housed in a circular groove realized in an inner diameter (19) of a well (18) of the basket.

6. A method for reducing the noise of a rotary hook (1) as per claim 1, comprising:

creating a friction between the bobbin case and the basket to prevent the bobbin case from freely vibrating within the plays present between said bobbin case and said basket.

* * * * *